United States Patent [19]

Yajima

[11] Patent Number: 4,865,000

[45] Date of Patent: Sep. 12, 1989

[54] AIR-FUEL RATIO CONTROL SYSTEM FOR INTERNAL COMBUSTION ENGINE HAVING EVAPORATIVE EMISSION CONTROL SYSTEM

[75] Inventor: Junichi Yajima, Yokohama, Japan

[73] Assignee: Nissan Motor Co., Ltd., Japan

[21] Appl. No.: 100,892

[22] Filed: Sep. 25, 1987

[30] Foreign Application Priority Data

Sep. 26, 1986 [JP] Japan ..... 61-227692

[51] Int. Cl.[4] ..... F02M 29/00

[52] U.S. Cl. ..... 123/520; 123/458

[58] Field of Search ..... 123/458, 518, 519, 520, 123/521

[56] References Cited

U.S. PATENT DOCUMENTS

| | | | |
|---|---|---|---|
| 4,467,769 | 8/1984 | Matsumura | 123/520 |
| 4,641,623 | 2/1987 | Hamburg | 123/520 |
| 4,664,087 | 5/1987 | Hamburg | 123/520 |
| 4,677,956 | 7/1987 | Hamburg | 123/520 |
| 4,683,861 | 8/1987 | Breitkreuz | 123/458 |

FOREIGN PATENT DOCUMENTS

| | | |
|---|---|---|
| 57-86555 | 5/1982 | Japan . |
| 57-129247 | 8/1982 | Japan . |

*Primary Examiner*—Carl Stuart Miller

*Attorney, Agent, or Firm*—Lowe, Price, LeBlanc, Becker & Shur

[57] ABSTRACT

Herein disclosed is an air-fuel ratio control system for an internal combustion engine which has at its evaporative emission control system a charcoal canister for trapping fuel vapors from a fuel tank or the like. An electromagnetic valve of a type which increases its open degree which increases a duty value represented by an instruction signal applied thereto is disposed in a purge line by which the canister and an induction passage of the intake system of the engine is fluidly connected. A feedback correction value is provided from a difference between an actual air-fuel ratio of the air-fuel mixture and a target air-fuel ratio for operating the engine under a feedback control. A control unit is provided which reduces the duty value when the engine operation is under the feedback control and the feedback correction value exceeds a predetermined control range.

12 Claims, 7 Drawing Sheets

AIR-FUEL RATIO CONTROL SYSTEM FOR INTERNAL COMBUSTION ENGINE HAVING EVAPORATIVE EMISSION CONTROL SYSTEM

BACKGROUND OF THE INVENTION

1. Field of the Invention

The present invention relates in general to an air-fuel ratio control system for an internal combustion engine, and more particularly to an air-fuel ratio control system which is applied to internal combustion engines of a type which has an evaporative emission control system.

2. Description of the Prior Art

In order to prevent the escape of fuel vapors from the fuel tank and the intake system of an internal combustion engine, evaporative emission control systems (EECS) have been widely employed in modern motor vehicles. In the systems, an activated charcoal canister is used to trap the vapors when the engine is shut off. Upon restarting, a flow of filtered air through the canister purges the vapors from the canister. The vapors go through one or more tubes (purge line) feeding into an induction passage downstream of a throttle valve of the intake system, and they are burnt in the engine.

In an engine controlled by a so-called "air-fuel ratio feedback control system", the vapors introduced into the induction passage tend to disturb the air-fuel ratio of the mixture has been previously adjusted by the control system. In order to deal with this undesired disturbance, various measures have been hitherto proposed and put into practical use. Some of them are disclosed in Japanese Patent First Provisional Publication Nos. 57-86555 and 57-129247.

In these measures, an electromagnetic valve is connected to the purge line to control the amount of the vapors supplied to the induction passage from the charcoal canister in accordance with an information signal issued from an air-fuel ratio sensor disposed in the exhaust system of the engine. That is, the valve is of a type in which the valve open degree increases in proportion to a duty value (viz., the rate of the time for which the valve opens to the entire time for which the same effects the open and close cycles). In the measures, the duty value based on an air induction rate is corrected in accordance with the information signal from the air-fuel ratio sensor thereby to put the influence of the disturbance in a controlled range.

When, for example, the engine is restarted after long standstill, the initially purged vapors from the charcoal canister contain a larger amount of fuel, so that the air-fuel ratio previously set by the air-fuel ratio control system is forced to deviate from a desired value (viz., stoichiometric value) causing the air-fuel mixture actually burned in the engine to become rich. Upon this, the air-fuel ratio sensor in the exhaust system issues a signal representing that the mixture has become richer than stoichiometric by a degree corresponding to the amount of the rich vapors, and the duty value is decreased for reducing the amount of the vapors fed to the induction passage. With this, the air-fuel ratio of the mixture is returned to the desired value.

In general, the air-fuel ratio feedback control is used only in a feedback control zone wherein the substantive air-fuel ratio of the mixture actually supplied to the engine can be controlled within a predetermined range which includes a desired air-fuel ratio as a base value. This is because using the feedback control zone can deal with not only a relatively large change in the air-fuel ratio but also a requirement for achieving a relatively stable control of the air-fuel ratio. That is, the feedback control zone is a balanced zone in which the above-mentioned two matters are achieved at the same time.

Apart from the above, the amount of fuel contained in the purged vapors changes largely in accordance with the time for which the engine has been at standstill and the temperature at which the engine (namely, associated vehicle) has been kept. Thus, it has been inevitably necessary to match the air-fuel ratio control range with the air-fuel ratio of the mixture which is prepared based on the engine standstill time and the engine temperature. Thus, when, after a long standstill, the engine is restarted and the operation of the engine is brought into the feedback control zone, the larger amount of fuel inevitably contained in the initially purged vapors causes the air-fuel mixture in the induction system to become rich instantly, so that the correction value to the feedback control exceeds the limit of the control range.

This will be understood from FIGS. 8, 9 and 10 of the attached drawings, in which the correction value to the feedback control is denoted by "$\alpha$". Hereinafter, the correction value to the feedback control will be referred to as "feedback correction value".

FIG. 8 shows the waveform of the feedback correction value "$\alpha$" which is used for a proportional-plus-integral control. As is seen from this waveform, usually, the correction value "$\alpha$" varies between the maximum value "$\alpha$MAX" and the minimum value "$\alpha$MIN" of the control range. However, when the engine is under the above-mentioned air-fuel ratio feedback control carried out just after a long standstill thereof, the air-fuel ratio is forced to greatly change and thus the correction value "$\alpha$" exceeds the control range. In this condition, the value "$\alpha$" adopts the upper or lower limit value of the range in place of a calculated value, so that as is seen from FIGS. 9 and 10, the feedback correction value "$\alpha$" takes the maximum or minimum value "$\alpha$MAX" or "$\alpha$MIN" thereafter. This means that a substantial feedback control is impossible any longer thereby bringing about deterioration of composition of the exhaust gases from the engine.

SUMMARY OF THE INVENTION

It is therefore an object of the present invention to provide an air-fuel ratio feedback control system which is free of the above-mentioned drawbacks.

According to the present invention, there is provided an air-fuel ratio feedback control system for an internal combustion engine, which decreases the amount of purged vapors supplied from the charcoal canister to the intake system when the engine operation is under an air-fuel ratio feedback control and the feedback correction value "$\alpha$" exceeds the control range.

According to the present invention, there is provided an air-fuel ratio control system for an internal combustion engine, which comprises first means for operating the engine under a feedback control by controlling the amount of air-fuel mixture fed to the engine with reference to a feedback correction value provided based on a difference between an actual air-fuel ratio of the air-fuel mixture and a target air-fuel ratio; a charcoal canister which traps fuel vapors from fuel containing means; a purge line providing a fluid communication between the charcoal canister and an induction passage of the engine; a purge valve connected to the purge line, the purge valve increasing its open degree with increase of a duty value represented by an instruction signal applied thereto; second means for controlling, when the engine is under the feedback control, the duty value of the instruction signal in accordance with an operation condition of the engine; third means for judging whether the feedback correction value exceeds a predetermined control range or not; and fourth means for reducing the duty value when the engine is operating under the feedback control and the feedback correction value exceeds the predetermined control range.

DETAILED DESCRIPTION OF THE INVENTION

Figure 1:
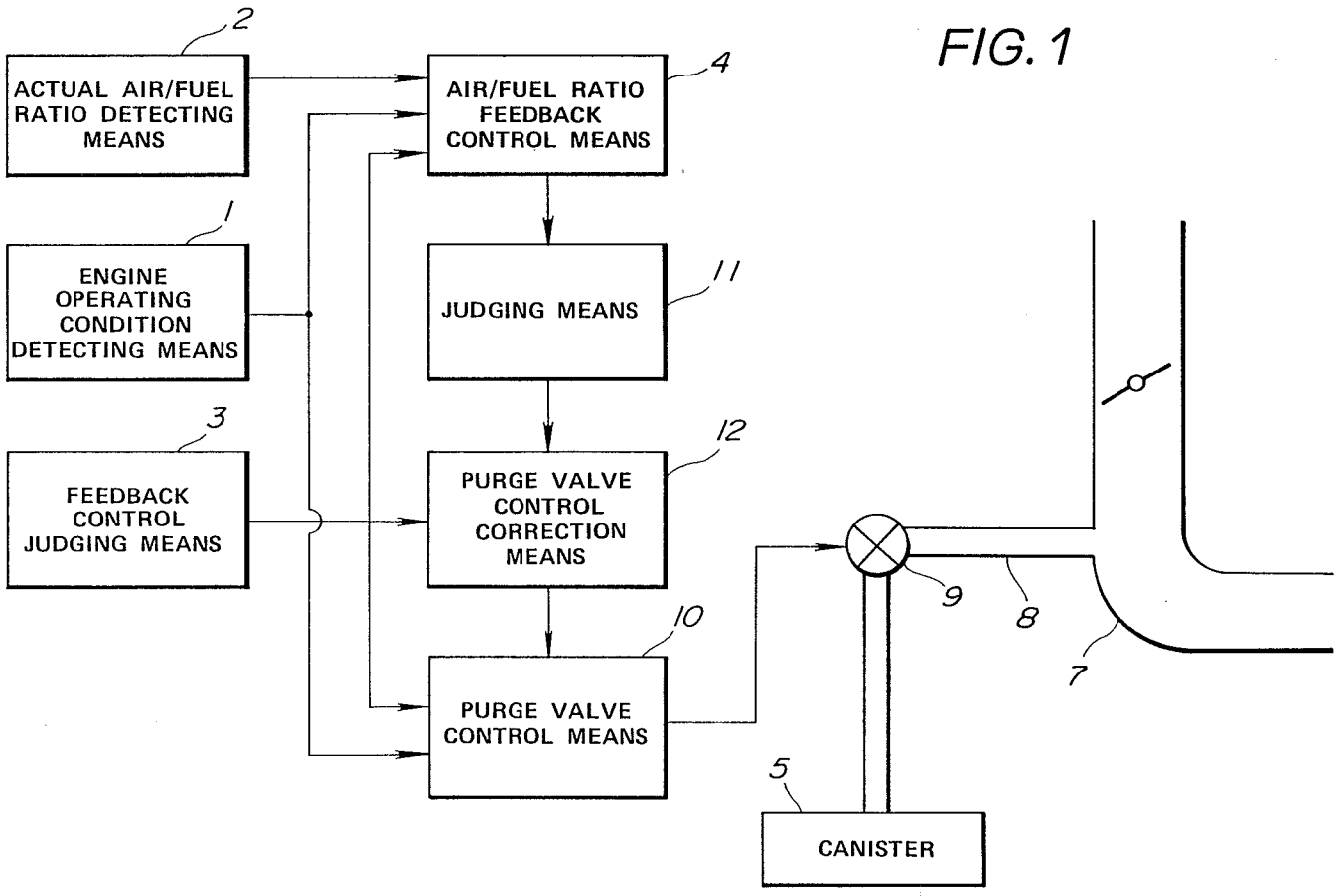
FIG. 1 is a block diagram depicting the concept of the present invention.
Figure 2:
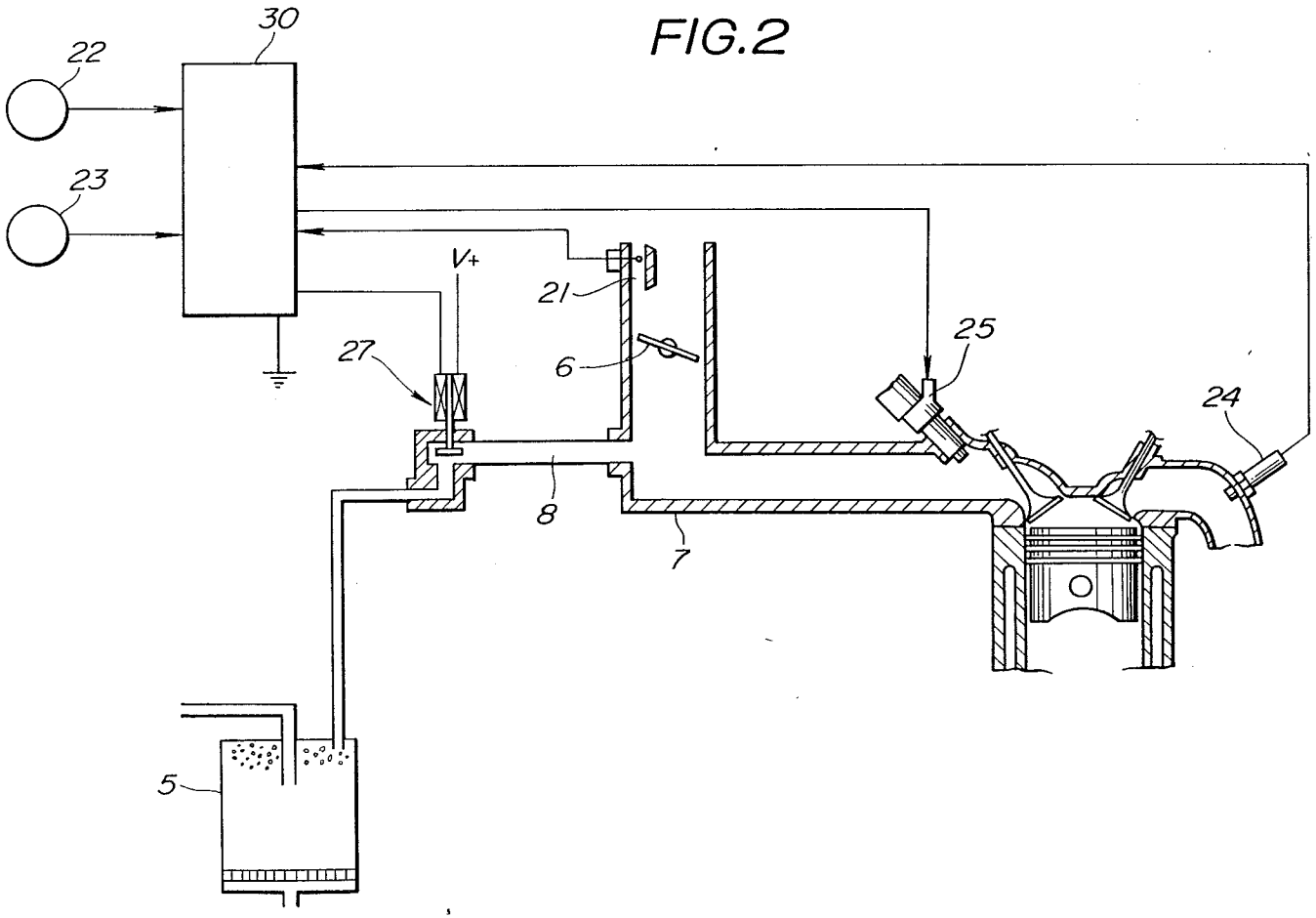
FIG. 2 is a schematic illustration of a mechanical part of a first embodiment of the present invention.

Referring to FIG. 2, there is shown a first embodiment of the present invention, in which a purge valve 27 connected to a purge line 8 is of a type which increases its open degree in proportion to the duty value. It is to be noted that the arrangement of the mechanical parts is conventional.

That is, engine operation sensors (viz., airflow sensor 21, crankangle sensor 22 and water temperature sensor 23) for sensing the operating condition of the engine, an air-fuel ratio sensor 24 mounted in an exhaust system, fuel injection valves 25 and a control unit 30 constitute an air-fuel ratio feedback control system. The control unit 30 comprises means which, by treating signals from the sensors, judges whether the operation of the engine is in the feedback control zone or not, and means which, upon the engine operation being judged to be in the feedback control zone, controls the amount of fuel injected by the injection valves 25 in a manner to match the actual air-fuel ratio with a desired ratio. For example, in "L-Jetronic technique", in order to provide a desired pulse width Ti for fuel injection, a base pulse width $Tp$ ($=K\times Qa/N$, wherein, K is a constant) based on operation variables (such as, intake air amount Qa and engine rotation speed N) is corrected by both correction values (the total of these values is represented by COEF) based on the other operation variables and a feedback correction value "$\alpha$" which is calculated from a difference between the actual air-fuel ratio and the desired air-fuel ratio.

That is, the desired pulse width Ti is provided by the following equation.

$$Ti=Tp\times(COEF)\times\alpha+Ts \quad (1)$$

wherein:

Ts is effective pulse width.

An activated charcoal canister 5, a purge line 8 which connects the canister 5 with an induction passage 7 just downstream of a throttle valve 6 of the intake system, the purge valve 27 disposed to the purge line 8 and the control unit 30 constitute a so-called purged vapor control system. The control unit 30 comprises means which calculates a base value (viz., base duty value) Dpo of duty value, applied to the purge valve 27 in accordance with the operation condition of the engine, and means which corrects the base duty value Dpo in accordance with the actual air-fuel ratio.

In accordance with the present invention, the following measure is further provided. That is, there are employed means which judges whether the feedback correction value "$\alpha$" exceeds a predetermined control range or not, and means which decreases the purge valve control degree (viz., duty value) when the operation of the engine is under the air-fuel ratio feedback control and the feedback correction value "$\alpha$" exceeds the predetermined control range.

Figure 3:
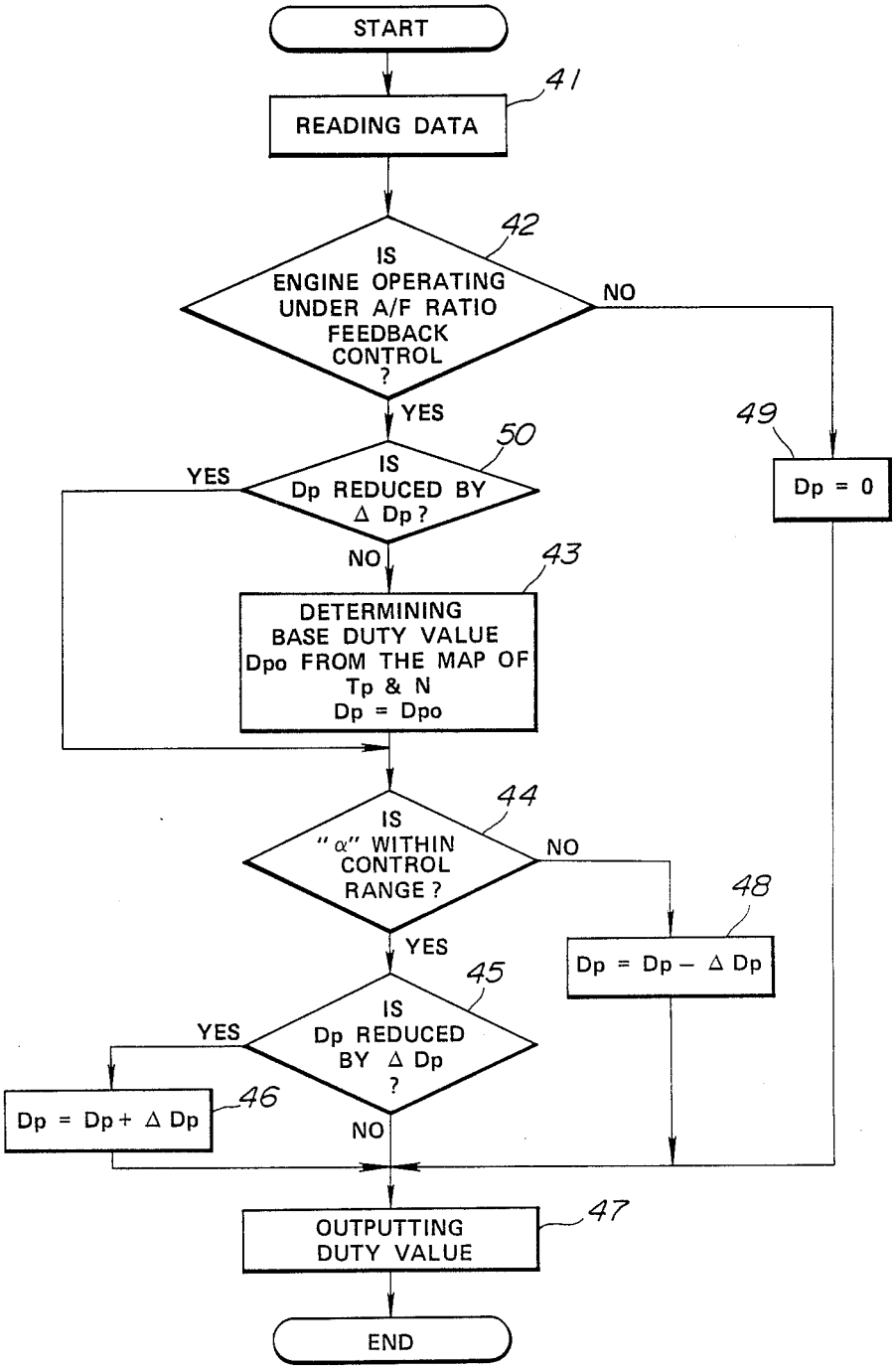
FIG. 3 is a flowchart describing the steps of operation carried out in a control unit employed in the first embodiment of the present invention.

These functions are accomplished by applying the control routine of FIG. 3 to program proceeded by a microcomputer of the control unit 30, which routine is carried out once per each rotation of the engine.

It is to be noted that the duty value control carried out in the invention is effected only when the engine is under the air-fuel ratio feedback control. This is because of reasons which will be described in the following.

That is, since, as has been mentioned hereinafore, the amount of fuel contained in the purged vapors varies in accordance with the length of time for which the associated engine has been at a standstill, a feedback control wherein the value of output quantity is controlled by feeding back the value of the controlled quantity is inevitably necessary in order to achieve a desired air-fuel ratio of the mixture while overcoming the disturbance caused by the purged vapors. If the duty value control is carried out in a mode wherein an open-loop control is being carried out, it becomes completely impossible to provide a desired air-fuel ratio of the mixture which is to be actually burnt in the engine.

In view of the above, in the present invention, the judgement as to whether or not the operation of the engine is under the air-fuel ratio feedback control is made by reading the data (viz., the base pulse width Tp, engine rotation speed N, output from the air-fuel ratio sensor, the feedback correction value "$\alpha$", the temperature of cooling water, etc.,) of the engine operation variables and comparing these data with their reference values (STEP 41, STEP 42). For example, the cease of the air-fuel ratio feedback control may take place when the air-fuel ratio sensor 24 is not still warmed, the temperature of the engine cooling water is till low (viz., lower than 60° C.), the engine is just started, the engine is under high load condition and/or the associated vehicle is under deceleration. Thus, when the engine is operating under a condition other than the above-mentioned conditions, it is judged that the engine operation is within the feedback control zone. When the engine is operating in a range out of the control zone, the duty value Dp is made zero to fully close the purge valve 27 (STEP 42, STEP 49).

The base duty value Dpo should be so determined that the amount of the purged vapors fed to the induction passage 7 is controlled in accordance with the condition of the engine. Like in the conventional feedback control, the duty value is determined in accordance with the intake air amount Qa. This is made for generally levelling a changing rate of the air-fuel ratio irrespective of the amount of the intake air. Usually, the rate of the air-fuel ratio change caused by the purged vapors to the intake air amount is higher in a lower load condition of the engine than in a lower load condition. Thus, by controlling the amount of the purged vapors in proportion to the intake air amount, the rate of the amount of the purged vapors to the intake air amount is levelled.

Figure 4:
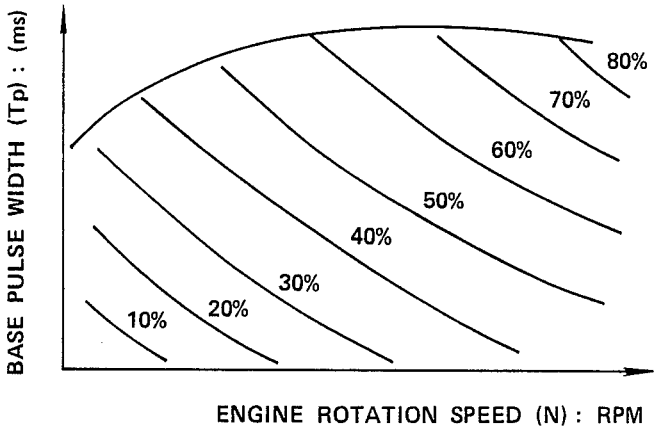
FIG. 4 is a map showing the characteristics of a duty value employed in the first embodiment.

In this first embodiment, the base duty value Dpo (%) is determined in accordance with both the base pulse width $Tp$ ($=K\times Qa/N$) and the engine rotation speed N, as is depicted by the map of FIG. 4. This is because, as is seen from the shape of this map, using the base pulse width Tp brings about a smoothed curve of the map thereby facilitating the search of the base duty value. As is seen from the map, the base duty value Dpo is increased with increase of the base pulse width Tp and increase of the engine rotation speed N. In the flowchart of FIG. 3 the map reading is made at STEP 43. There, the base duty value Dpo is put as a new duty value.

The reason for generally levelling the contribution rate of the purged vapor amount throughout various operation conditions of the engine is based on a presumption that the amount of fuel contained in the purged vapors is generally equal throughout the various operation conditions. However, as is known, actually, the amount of the fuel contained in the purged vapors changes considerably in accordance with the period for which the engine has been at standstill and the temperature at which the associated vehicle (or the engine) has been kept. That is, when the feedback control for the air-fuel ratio is carried out after long standstill of the engine, it tends to occur, due to increased amunt of fuel contained in the initially purged vapors, that the feedback correction value "α" is forced to take the a rich side limit value. Of course, under this condition, normal feedback control can not be effected.

However, in the invention, this condition is treated by a so-called "fail-safe means".

That is, in order not to allow the feedback correction value "α" to take the rich side limit value, it is only necessary to reduce the purged vapors which are to be fed into the induction passage of the intake system. Thus, in the invention, when judging that the value "α" has exceeded the control range (that is, when the feedback correction value "α" takes the rich side limit), the duty value Dp is reduced by a predetermined degree Δ Dp to reduce the purged vapor amount (STEP 44, STEP 48).

Figure 5:
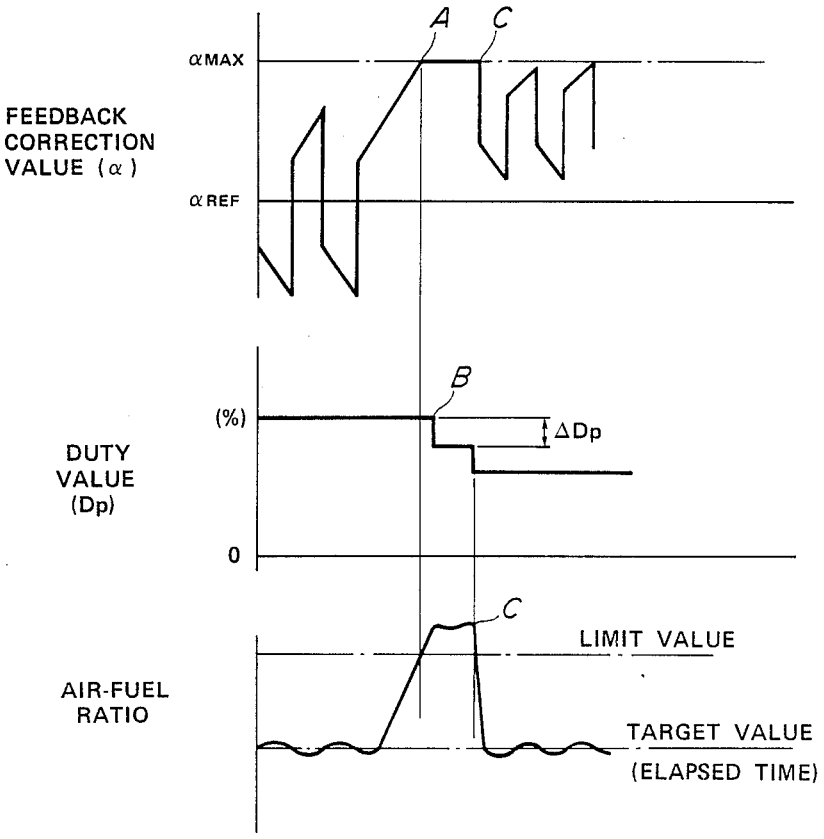
FIG. 5 is an illustration showing waveforms of various values which are employed in the first embodiment.

In the following, operation of the air-fuel ratio feedback control system of the first embodiment will be described with reference to FIG. 5 which shows waveforms of the feedback correction value "α", the duty value Dp and the air-fuel ratio which are gained when, after a long standstill, the associated engine comes into the feedback control zone.

That is, the air-fuel ratio feedback control starts when, after a warm up thereof, the engine is still under low load. Under this control, the feedback correction value "α" changes within the control range, so that the actual air-fuel ratio of the mixture to be burnt in the engine changes within the predetermined control range the base of which is a stoichiometric value.

When judging that the operation of the engine is under the feedback control, the purge valve is opened and the base duty value Dpo at this time is read from the map of FIG. 4 (STEP 42, STEP 43), and the purged fuel in the amount corresponding to the duty value is introduced into the induction passage of the intake system. Because the initially purged vapors contain a larger amount of fuel, the air-fuel mixture actually burnt in the engine becomes extremely rich deviating from the disired (or stoichiometric) air-fuel ratio. Accordingly, the feedback correction value "α" takes the rich side limit of the control range (the point indicated by reference "A" in FIG. 5). In the prior art, there is no measure for dealing with this undesired condition, so that harmful contents in the exhaust gases from the engine are increased.

However, in the first embodiment of the present invention, this undesired condition is judged and instantly the duty value Dp is reduced by a degree Δ Dp at the time "B" (STEP 44, STEP 48). Thus, the mixture to be burnt in the engine becomes lean by a degree corresponding to the reduction in the duty value, so that the actual air-fuel ratio of the mixture and the feedback correction value "α" are returned into their control ranges at the time "C". If the reduction in duty value is not sufficient for achieving a desired air-fuel ratio, the reduction step is repeated until achieving the desired air-fuel ratio (STEP 50, STEP 44, STEP 48, see FIG. 5). It is to be noted that putting the feedback correction value "α" into the control range means that the feedback control, viz., the control for operating the engine in a stoichiometric manner becomes possible.

That is, in accordance with the present invention, a reference value of purged vapor amount is determined by considering not only the amount of fuel contained in vapors which are purged from the activated charcoal canister at the time when the associated engine is restarted after long standstill but also the temperature at which the engine has been kept. The control range is so determined that a normal feedback control can be carried out when the amount of fuel in the purged vapors is about the reference value. When, however, the amount of fuel in the purged vapors is largely deviated from the predetermined reference value, the purged vapors fed to the induction passage is reduced for the purpose of returning the feedback control to its normal state. With this, the increase of the harmful contents in the exhaust gases, which would occur upon restarting of the engine after long standstill of the same, is prevented or at least minimized.

When the feedback correction value "α" comes into the control range, the duty value Dp is increased by a degree of Δ Dp for reforming a base duty value Dpo (STEP 45, STEP 46).

Figure 6:
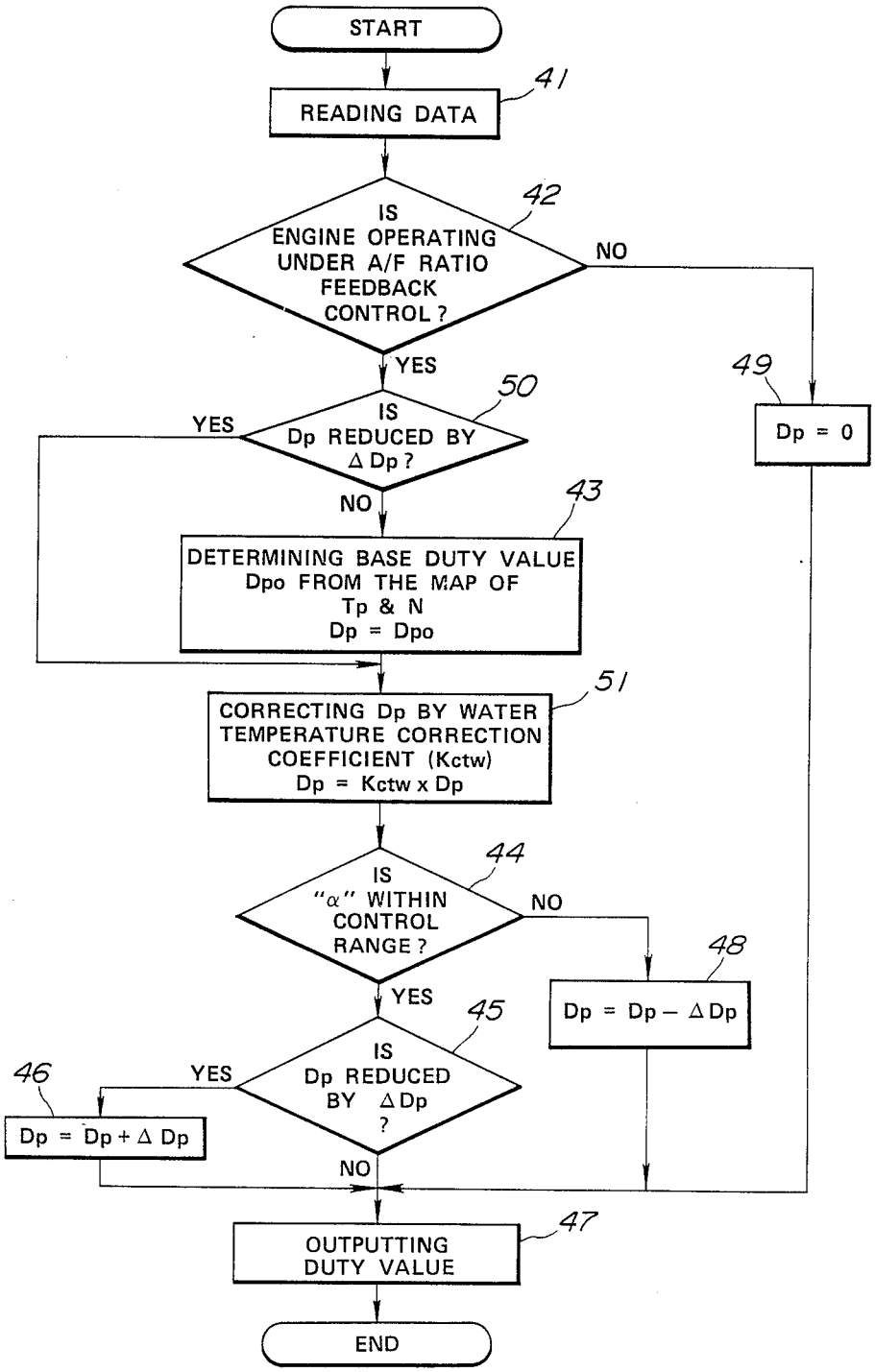
FIG. 6 is a flowchart describing the steps of operation carried out in a second embodiment of the present invention.
Figure 7:
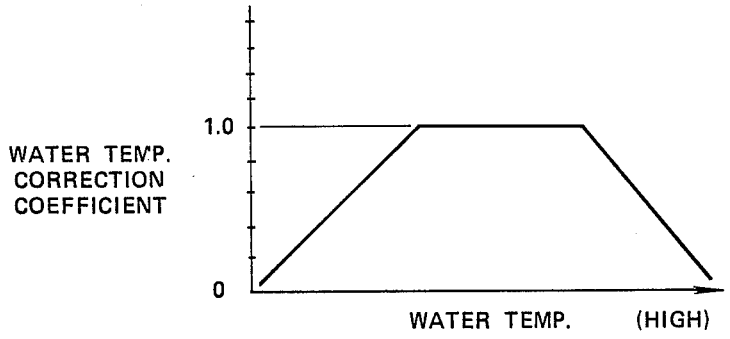
FIG. 7 is a graph showing the characteristic line of a correction coefficient determined by water temperature, which is employed in the second embodiment.
Figure 8:
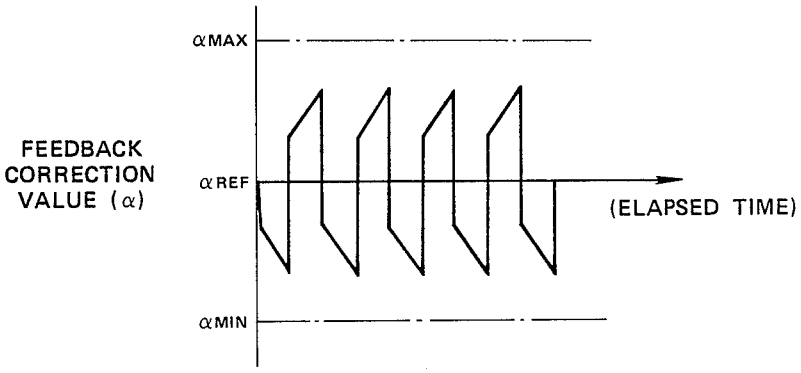
FIGS. 8 to 10 are illustrations showing waveforms of the feedback correction value, which is employed in a conventional air-fuel ratio feedback control system.
Figure 9:
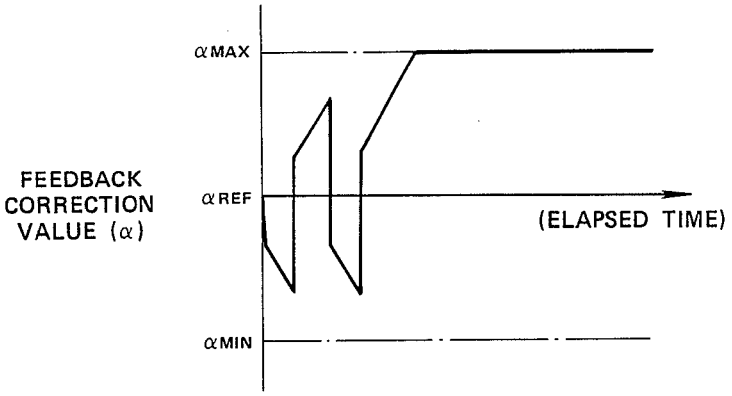
Figure 10:
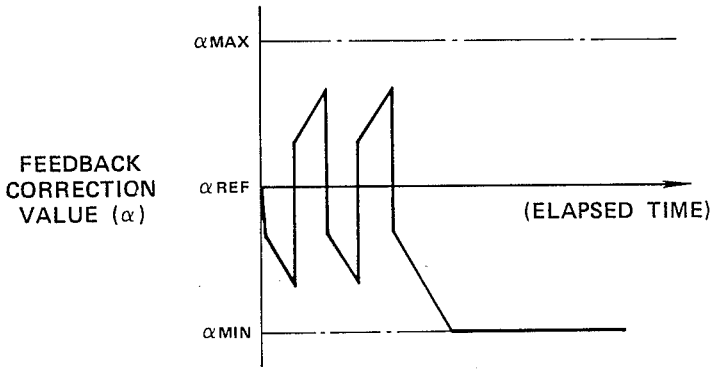

Referring to FIG. 6, there is shown a flowchart depicting the steps of operation carried out in an air-fuel ratio feedback control system of a second embodiment of the present invention. In this second embodiment, the duty value Dp is corrected in accordance with an engine temperature (for example, the temperature of engine cooling water). This is achieved by considering a fact wherein even under feedback control, the engine with the cooling water being relatively low in temperature tends to be fed with a relatively rich mixture, and when the water temperature is high, fluctuations in the air-fuel ratio tend to affect badly the operation of the engine. That is, upon subjecting to these undesirable conditions in temperature, the duty value is reduced correspondingly in the second embodiment. As is seen from the illustration of FIG. 7, a water temperature correction coefficient Kctw is used for correcting the duty value Dp (STEP 51).

What is claimed is:

1. An air-fuel ratio control system for an internal combustion engine, comprising:

first means for operating said engine under a feedback control by controlling the amount of air-fuel mixture fed to said engine with reference to a feedback correction value ($\alpha$) provided based on a difference between an actual air-fuel ratio of the air-fuel mixture and a target air-fuel ratio;

a charcoal canister which traps fuel vapors from fuel containing means;

a purge line providing a fluid communication between said charcoal canister and an induction passage of the engine;

a purge valve connected to said purge line, said purge valve increasing its open degree with increase of a duty value (Dp) represented by an instruction signal applied thereto;

second means for controlling, when said engine is under said feedback control, said duty value of the instruction signal in accordance with an operation condition of the engine;

third means for judging whether the feedback correction value exceeds a pedetermined control range or not; and fourth means for reducing said duty value when the engine is operating under said feedback control and said feedback correction value exceeds said predetermined control range.

2. An air-fuel ratio control system as claimed in claim 1, in which said feedback correction value ($\alpha$) satisfies the following equation:

$$Ti = Tp \times (COEF) \times \alpha + Ts$$

wherein Ti is a desired pulse width of pulses applied to an injection valve disposed in an intake system of the engine;

Tp is a base pulse width determined based on an intake air amount (Qa) and an engine rotation speed (N);

(COEF) is a total of correction values determined based on engine operation valuables other than said intake air amount and the engine rotation speed;

and Ts is ineffective pulth width.

3. An air-fuel ratio control system as claimed in claim 2, in which said base pulse width (Tp) is represented by the following equation:

$$Tp = K \times Qa/N,$$

wherein K is a constant.

4. An air-fuel ratio control system as claimed in claim 3, in which said duty value becomes zero when the engine is operating under a mode other than said feedback control.

5. An air-fuel ratio control system as claimed in claim 4, in which the feedback control of the engine ceases when an air-fuel sensor mounted in an exhaust system of the engine is low in temperature, engine cooling water is low in temperature, the engine is just restarted, the engine is operating under high load condition and the associated vehicle is subjected to deceleration.

6. An air-fuel ratio control system as claimed in claim 5, in which the feedback control of the engine ceases when the temperature of the engine cooling water is lower than about 60° C.

7. An air-fuel ratio control system as claimed in claim 6, in which said duty value (Dp) has a base duty value (Dpo) which is determined in accorance with the amount of air supplied to the induction passage of the engine.

8. An air-fuel ratio control system as claimed in claim 7, in which said base duty value (Dpo) is determined in accordance with both said base pulse width (Tp) and the engine rotation speed (N).

9. An air-fuel ratio control system as claimed in claim 8, in which said base duty value increases with increase of said base pulth width (Tp) and increase of said engine rotation speed (N).

10. An air-fuel ratio control system as claimed in claim 9, in which said duty value (Dp) is reduced by a predetermined degree ($\Delta$ Dp) when said feedback correction value ($\alpha$) exceeds the control range.

11. An air-fuel ratio control system as claimed in claim 8, in which said duty value (Dp) is determined in accordance with an information representing of engine temperature.

12. An air-fuel ratio control system as claimed in claim 11, in which said duty value (Dp) is determined in accordance with the temperature of the engine cooling water.

* * * * *